US009661937B2

(12) United States Patent
Lundgren et al.

(10) Patent No.: US 9,661,937 B2
(45) Date of Patent: May 30, 2017

(54) CARRIER FRAME FOR A CHILD CARRIER

(71) Applicant: Thule IP AB, Malmö (SE)

(72) Inventors: Anders Lundgren, Grimås (SE); Henrik Kax, Stockholm (SE)

(73) Assignee: Thule IP AB, Malmö (SE)

( * ) Notice: Subject to any disclaimer, the term of this patent is extended or adjusted under 35 U.S.C. 154(b) by 68 days.

(21) Appl. No.: 14/632,605

(22) Filed: Feb. 26, 2015

(65) Prior Publication Data

US 2015/0245718 A1 Sep. 3, 2015

(30) Foreign Application Priority Data

Mar. 3, 2014 (EP) ..... 14157488

(51) Int. Cl.

| | |
|---|---|
| ***A45F 4/02*** | (2006.01) |
| ***A61G 5/00*** | (2006.01) |
| ***A61G 1/00*** | (2006.01) |
| ***A45F 3/00*** | (2006.01) |
| ***A47D 13/02*** | (2006.01) |
| ***A45F 3/08*** | (2006.01) |

(52) U.S. Cl.

CPC ..... *A47D 13/025* (2013.01); *A45F 3/08* (2013.01); *A47D 13/02* (2013.01)

(58) Field of Classification Search

CPC ..... A47D 13/025; A47D 13/02; A45F 3/10; A45F 3/04; A45F 4/02

USPC ..... 224/161, 160, 628, 637, 155, 158, 159

See application file for complete search history.

(56) References Cited

U.S. PATENT DOCUMENTS

| | | | | |
|---|---|---|---|---|
| 3,713,568 A * | 1/1973 | Sloan | ..... | A47D 13/025 224/161 |
| 3,989,173 A * | 11/1976 | Gebhard | ..... | A47D 13/025 224/155 |
| 4,044,931 A * | 8/1977 | Catelli | ..... | A47D 13/025 224/155 |

(Continued)

FOREIGN PATENT DOCUMENTS

| | | |
|---|---|---|
| DE | 10 2011 101966 | 11/2012 |
| JP | 2001 204593 | 7/2001 |
| JP | 2005 111194 | 4/2005 |

OTHER PUBLICATIONS

European Search Report for European Application No. 14 15 7488, European Patent Office, Munich, Germany, mailing date of Jul. 7, 2014, 4 pages.

*Primary Examiner* — Justin Larson
*Assistant Examiner* — Lester L Vanterpool
(74) *Attorney, Agent, or Firm* — Sterne, Kessler, Goldstein & Fox P.L.L.C.

(57) ABSTRACT

A carrier frame for a child carrier is disclosed. The carrier frame includes a first frame element and a second frame element hingedly coupled to the first frame element about a hinge axis. The first frame element includes a main frame and an adjustable support. The adjustable support extends in a first direction substantially parallel to the hinge axis and is movable in a second direction substantially perpendicular to the hinge axis. The second frame element comprises a transition portion and a backrest portion. An angle is formed between the backrest portion and the transition portion. The transition portion has a width in the first direction smaller than a maximum width of the carrier frame.

15 Claims, 12 Drawing Sheets

(56) References Cited

U.S. PATENT DOCUMENTS 4,676,466 A * 6/1987 Nakao ..... A47D 13/025 16/333
4,762,256 A * 8/1988 Whitaker ..... A45F 3/10 224/155
5,419,281 A * 5/1995 Williams ..... A01K 1/0254 119/497
D378,017 S * 2/1997 Svendsen ..... D12/129
5,609,279 A * 3/1997 O'Shea ..... A47D 13/025 224/155
5,626,271 A * 5/1997 Messey ..... A47D 13/025 224/158
5,704,523 A * 1/1998 Wang ..... A47D 13/025 224/158
D394,546 S * 5/1998 Svendsen ..... D3/214
6,073,820 A * 6/2000 Drobinski ..... A47D 13/025 224/155
6,089,425 A * 7/2000 Fair ..... A47D 13/025 224/160
6,092,543 A * 7/2000 Roh ..... A47C 7/66 135/96
6,158,641 A * 12/2000 Eyman ..... A47D 13/025 224/161
6,283,347 B1 * 9/2001 Roh ..... A47D 13/025 2/4
6,318,608 B1 * 11/2001 Fowler ..... A47D 13/025 224/159
6,378,892 B1 * 4/2002 Hsia ..... A47D 13/025 280/642
6,575,342 B1 * 6/2003 Sundara ..... A47D 13/025 224/158
6,840,419 B2 * 1/2005 Penny ..... A45F 3/047 224/631
8,011,722 B2 * 9/2011 Cui ..... A47D 1/02 297/16.1
2004/0065704 A1 * 4/2004 Penny ..... A45F 3/047 224/161
2005/0045675 A1 * 3/2005 Redlinger ..... A47D 13/025 224/161
2005/0077331 A1 * 4/2005 Keller ..... A47D 13/025 224/161
2009/0032558 A1 * 2/2009 Klein, II ..... A47D 13/025 224/161

* cited by examiner

CARRIER FRAME FOR A CHILD CARRIER

BACKGROUND

The present subject matter relates to a carrier frame for a child carrier as well as to a child carrier comprising such a carrier frame.

Known child carriers typically comprise a carrier frame which is designed to provide a support for a compartment into which a child can be seated. The space provided is usually variable by moving different frame elements with respect to each other. The requirements for such a child carrier are in particular the adaptability to the child to be seated as well as the adaptability to a user carrying such a child carrier.

As regards the adaptability to the user, known child carriers comprise two shoulder straps which are height-adjustable. Consequently, the child carrier can be adapted to different sizes of users. However, the known height-adjustment systems are inconvenient and complicated to use.

SUMMARY

The present subject matter relates to a carrier frame for a child carrier and a child carrier comprising such a carrier frame.

According to a first aspect of the present subject matter, a carrier frame for a child carrier comprises a first frame element and a second frame element. Preferably, the second frame element is hingedly coupled to the first frame element about a hinge axis. Thus, the second frame element can be moved rotationally with respect to the first frame element about the hinge axis. Advantageously, the first frame element supports the second frame element against the back of a user. Therefore, the first frame element can have an elongate construction, at least ranging from the shoulders of a user to the hip of a user.

Moreover, the first frame element preferably comprises a main frame and an adjustable support. The adjustable support can extend in a first direction which is substantially parallel to the hinge axis and can be moveable in a second direction substantially perpendicular to the hinge axis.

Accordingly, the adjustable support is preferably moveable towards and away from the hinge axis and substantially perpendicular to its extension direction. The adjustable support can be moveably mounted on the main frame. This can be achieved by a construction in which the main frame and the adjustable support engage with each other, either directly or by means of a coupling element. Different configurations are possible in this respect. For instance, a portion of the adjustable support can be accommodated in the main frame or a portion of the main frame can be accommodated in the adjustable portion. Furthermore, it is possible to use a construction in which an engagement is provided in which the adjustable support cannot be disengaged from the main frame in the first direction. For instance, the adjustable support can be held between to elements of the main frame placed in contact with the longitudinal ends of the adjustable support.

Furthermore, it is preferred that the second frame element comprises a transition portion and a backrest portion. Advantageously, an angle is formed between the backrest portion and the transition portion. The backrest portion of the second frame element can be formed to provide a suitable support against which the back of a child can be placed. Preferably, the transition portion and the backrest portion are integrated and/or integrally formed. The angle at which the backrest portion and the transition portion can be formed preferably lies in a plane which is substantially perpendicular to the hinge axis. For instance, in case the transition portion and the backrest portion are integrally formed, the angle can be formed by bending the second frame element about a bending axis which is substantially parallel to the hinge axis.

Preferably, the transition portion has a width in the first direction which is smaller than a maximum width of the carrier frame. Thus, the width in the first direction of the transition portion is narrower than the maximum width of the carrier frame. In other words, the transition portion preferably forms a narrow section in the carrier frame.

Advantageously, the second frame element comprises two leg portions. Preferably, the leg portions are elongate portions each comprising at least one free end. At one free end of the leg portions, the second frame element is preferably coupled to the first frame element. This means that the second frame element can be coupled to the first frame element pivotably at the ends of the leg portions coupled to the first frame element.

Advantageously, the leg portions are formed substantially parallel and spaced to each other in the transition portion. In this connection, the leg portions can be formed such that a distance between the same remains constant in the transition portion. In other words, the two leg portions can be formed symmetrical with respect to a plane of symmetry provided therebetween. In connection with the above feature that the width in the first direction of the transition portion can be smaller than a maximum width of the carrier frame, this means that in the transition portion, the outer sides of the leg portions define a width of the second frame element which can be constant and which is smaller than the maximum width of the carrier frame.

According to a preferable construction, the leg portions are three-dimensionally formed and coupled to each other so as to form an open loop. For example, the leg portions can be coupled to each other at one of their ends whereas the other ends of the leg portions are free ends. Preferably, the free ends are hingedly coupled to the first frame element. It is advantageous, if the coupling portion of the leg portions is formed in the backrest portion. With such a construction, a high structural rigidity can be achieved.

Furthermore, the leg portions can have a tubular shape. Such a construction is beneficial because using elements having a tubular profile enables the use of thin-walled hollow members having a high rigidity whereas the weight can be reduced at the same time. Accordingly, the leg portions can be constructed with tube or pipe elements or can even be constructed of a single tube or a pipe which is correspondingly bent. Furthermore, it is advantageous if the leg portions have a substantially constant cross-sectional profile. Such tubular elements having a substantially constant cross-sectional profile are easy to manufacture while providing a sufficiently high rigidity.

According to a further embodiment of the present subject matter, the carrier frame further comprises a stand having two integrated stand leg portions. The stand leg portions can be hingedly coupled to the second frame element and preferably comprise a free end which is contactable to the ground. Thus, the stand leg portions can be suitably used for supporting the second frame element against the ground. Since the free ends of the leg portions get in contact with the ground when the leg portions are deployed so as to provide a supporting function, only a relatively small contact area exists between the leg portions and the ground. Furthermore, there are only two of such contact areas with the ground leading to a high stability. The stand leg portions can be made from aluminum and can be formed as a hollow profile. Accordingly, a tubular profile can be used which can be bent in a U-shape, wherein the two stand leg portions extend from a base of the U-shape. Preferably, the hinge axis of the stand extends substantially parallel to the hinge axis about which the seconds frame element is hingedly coupled to the first frame element. It is advantageous, if the stand leg portions are hingedly coupled to the transition portion of the second frame element.

According to an embodiment of the present subject matter, it is preferred that the main frame comprises two rack portions extending in the second direction. Accordingly, the two rack portions can be arranged to extend substantially perpendicular to the hinge axis where the second frame element is coupled to the first frame element. Preferably, the rack portions are straight. Each of the two rack portions can have a guide means for guiding the adjustable support. Such a guide means can be a track or a groove, for instance. The adjustable support can be arranged so as to extend between the two rack portions and is preferably slidably engaged with the guide means of the rack portions. Accordingly, the adjustable support is guided so as to be moveable in the second direction.

According to an embodiment of the present subject matter, the guide means is a groove and the adjustable support comprises a guided portion slidably accommodated in the groove. The groove can have any shape as long as a guided portion is able to be guided therein. Preferably, the guided portion is formed corresponding to or following the shape of the groove. Accordingly, a construction is achieved in which a space between the guided portion and the groove is reduced leading to a construction in which the adjustable support is reliably guided. The groove can be provided in the rack portion along the entire length of the same. Preferably, the groove is formed such that the guided portion has to be inserted in the longitudinal direction and cannot be inserted in a direction cross to the longitudinal direction, the first direction for instance. In other words, the guided portion is insertable into the groove in the second direction only. Thus, the guided portion cannot be disengaged in the first direction. With this construction, the distance between the two rack portions is substantially fixed.

According to an embodiment of the present subject matter, the main frame further comprises at least two connecting bars extending in the first direction and being coupled to the two rack portions. Accordingly, the distance between the two rack portions is fixed by means of the at least two connecting bars. Preferably, a rigid connection between the connecting bars and the rack portions is provided. Thus, the rack portions are mounted at a fixed distance from each other so that the guide means of the two rack portions are fixedly aligned with respect to each other. Consequently, a reliable guiding function is provided. Preferably, the connecting bars are made of plastic.

According to a further embodiment of the present subject matter, the carrier frame further comprises a locking mechanism for releasably locking the adjustable support with respect to the main frame. The locking function can be effected by friction-fit or by form-fit. That is, the adjustable support or at least a part thereof can be formed so as to be able to friction-fittedly or form-fittedly engage with a further element of the carrier frame so that the movement of the adjustable support with respect to the main frame is locked. Preferably, the locking mechanism comprises an element engageable with the main frame. In this connection, an element can be provided on the adjustable support, which engages with a counterpart provided in the main frame. Thus, a construction is achieved in which the movability of the adjustable support can be restricted with respect to the main frame. In particular, it is beneficial if the locking mechanism is able to prevent a movement of the adjustable support in the second direction. Alternatively, the locking mechanism can be provided in the main frame and can be constructed so as to engage with the adjustable support.

For example, in case the guide means is a groove and the adjustable support comprises a guided portion slidably accommodated in the groove as described above, it is possible to construct the guided portion to be able to establish a friction fit connection. At least a section of the guided portion can be formed such that it can be pressed against the walls of the groove. With such a construction it is possible to provide a continuously adjustable locking mechanism which is able to lock the adjustable support with respect to the main frame at any position.

According to a further embodiment of the present subject matter, the locking mechanism can comprise a locking element releasably engageable with a locking cavity of at least two locking cavities formed in the main frame. Such a locking element can have any shape as long it is possible to reliably engage with the corresponding locking cavity provided in the main frame. For example, the locking element can be a locking pin and the locking cavity can be a locking hole.

Preferably, the locking mechanism comprises a lever pivotably mounted about a pivot pin and being operatively connected to the locking element on one end and being actuatable at an actuating section provided at the other end. An actuation of the lever can be effected by pulling or pushing the lever at the actuating section. Consequently, by operating the actuating section of the lever, a movement of the locking element is induced which engages the locking element with or disengages the same from the locking cavity.

It is advantageous, if the locking mechanism comprises a spring element which pretensions the locking element in the engaging direction. Consequently, according to this construction, an engagement of the locking element with the locking cavity is maintained unless the actuating section of the lever is operated. In other words, the movement of the adjustable portion is restricted until the actuating section of the lever is operated so as to disengage the locking element from the locking cavity.

According to a further embodiment of the present subject matter, the adjustable support can comprise a shoulder strap attachment bar having at least two shoulder strap attachment means for directly attaching shoulder straps on the shoulder strap attachment bar. For example, such shoulder strap attachment means can be in the form of openings provided in the shoulder strap attachment bar. Thus, the shoulder strap attachment means can be integrally formed in the shoulder strap attachment bar. In this connection, the shoulder strap can be fixed on the shoulder strap attachment bar by passing an end of the shoulder strap through the opening provided in the shoulder strap attachment bar, wrapping the same about a portion of the shoulder strap attachment bar and sewing the free end of the shoulder strap to another portion of the same so as to form a loop. It is however also possible to fix the free end of the shoulder strap to the shoulder strap attachment bar by using other connections, such as a screw connection.

According to a second aspect of the invention, a child carrier comprises a carrier frame as described above, a harness arrangement comprising at least two shoulder straps, wherein the shoulder straps are coupled to the adjustable support, and a child seat arrangement comprising a saddle like seating. The harness arrangement can further comprise a hip belt provided at a lower end of the first frame element substantially at a position where the second frame element is coupled to the first frame element.

Preferably, the saddle like seating is arranged between the first frame element and the second frame element in the area of the transition portion, preferably in the first direction. In this connection, saddle like seating means a seating in which the seating surface extends between the legs of a child to be seated. Preferably, the saddle like seating is arranged close to the transition portion.

Furthermore, it is possible to provide an arrangement in which the saddle like seating is provided on the transition portion, preferably at least partially directly supported on the transition portion. Since the transition portion is a narrow portion as described above, a construction is achieved in which the legs of a seated child pass besides the transition portion and do not get in contact with the same. Accordingly, it is possible to provide a seating arrangement in which the legs of a seated child can dangle without getting in contact with the second frame element at the transition portion. Accordingly, the seating arrangement is more comfortable for the child. Furthermore, the risk of clamping the child's legs between the transition portion and the first frame element is reduced.

According to an embodiment of the present subject matter, the width of the transition portion is equal to or smaller than the width of the saddle like seating. In this connection, width of the saddle like seating means the width of the saddle like seating in the first direction. Accordingly, when viewing the saddle like seating from above, the transition portion is completely covered by the same at least at a portion of the saddle like seating at which the bottom of a seated child is placed. Consequently, a contact between the legs of a child and the transition portion of the second frame element is prevented to a great extent.

According to an embodiment of the present subject matter, the transition portion can be at least partially formed following the shape of the saddle like seating. Preferably, the saddle like seating comprises a rounded shape, preferably following the shape of the bottom of a child, when viewed in side view, that is, in the first direction. In this connection, the transition portion can be formed to at least partially follow such a shape. Accordingly, the transition portion can comprise multiple sections connected to each other with an angle so as to follow the form of the saddle like seating to a great extent. It is also possible to bend the transition portion corresponding to the form of the saddle like seating so as to maintain the distance between the saddle like seating and the transition portion substantially constant. On the other hand, in case the saddle like seating is directly provided on the transition portion so that the transition portion functions as a support of the saddle like seating, forming the transition portion according to the shape of the saddle like seating will provide additional seating comfort for the child to be seated.

According to an embodiment of the present subject matter, the child carrier can further comprise an adjustment strap arrangement for adjusting an angle between the first frame element and the second frame element. Preferably, the adjustment strap arrangement comprises at least one length adjustable strap operatively connected to the first frame element on one side and operatively connected to the second frame element on the other side. The length of the length adjustable strap can be adjusted by pulling a free end thereof. Advantageously, the length adjustable strap is arranged with its free end being positioned on a side of the first frame element. The adjustment strap arrangement can comprise two straps connected to each other by means of a side release buckle. The side release buckle can be a single or a double adjustment release buckle. In either case, an adjustment portion of the release buckle is provided so as to face the first frame element so that the end of the length adjustable strap is placed near the first frame element at a position in which the user can grab the same while carrying the child carrier on its back.

According to a further embodiment of the present subject matter, a leg loop strap arrangement is additionally provided. Preferably, the leg loop strap arrangement is provided between the saddle like seating and the adjustment strap arrangement when the child carrier is viewed in the first direction. By this, the dimension of an opening through which the child's leg is passed when it is seated can be reduced so that the child cannot slip through that opening when seated. Furthermore, the leg loop strap arrangement is length adjustable and can be suitably used to tighten the child's leg to the child carrier. Accordingly, the safety of the child carrier is further enhanced. Similarly to the adjustment strap arrangement, the leg loop strap arrangement can comprise a side release buckle for opening the same.

DETAILED DESCRIPTION

Figure 1:
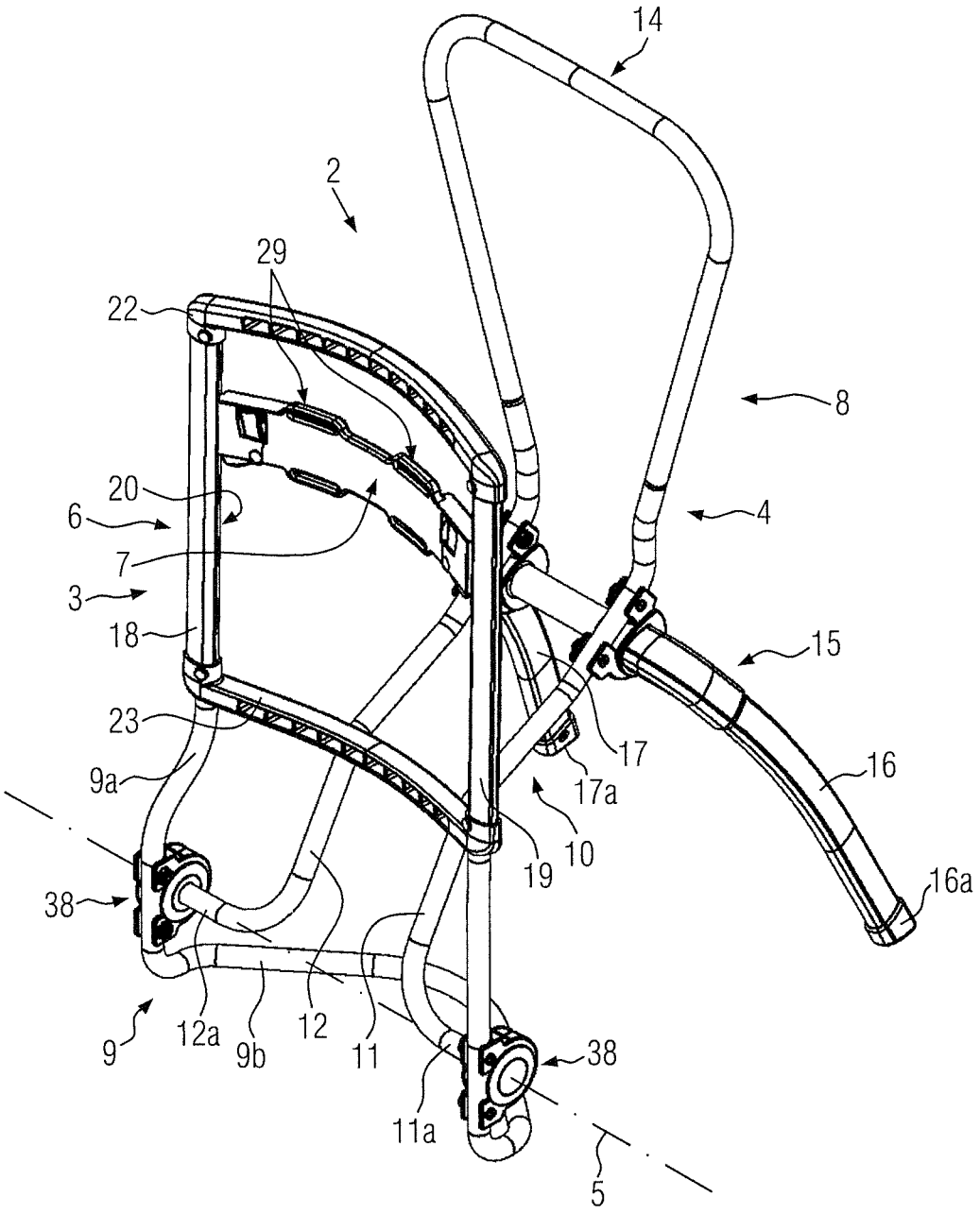
FIG. 1 shows a perspective view of a carrier frame for a child carrier.
Figure 2:
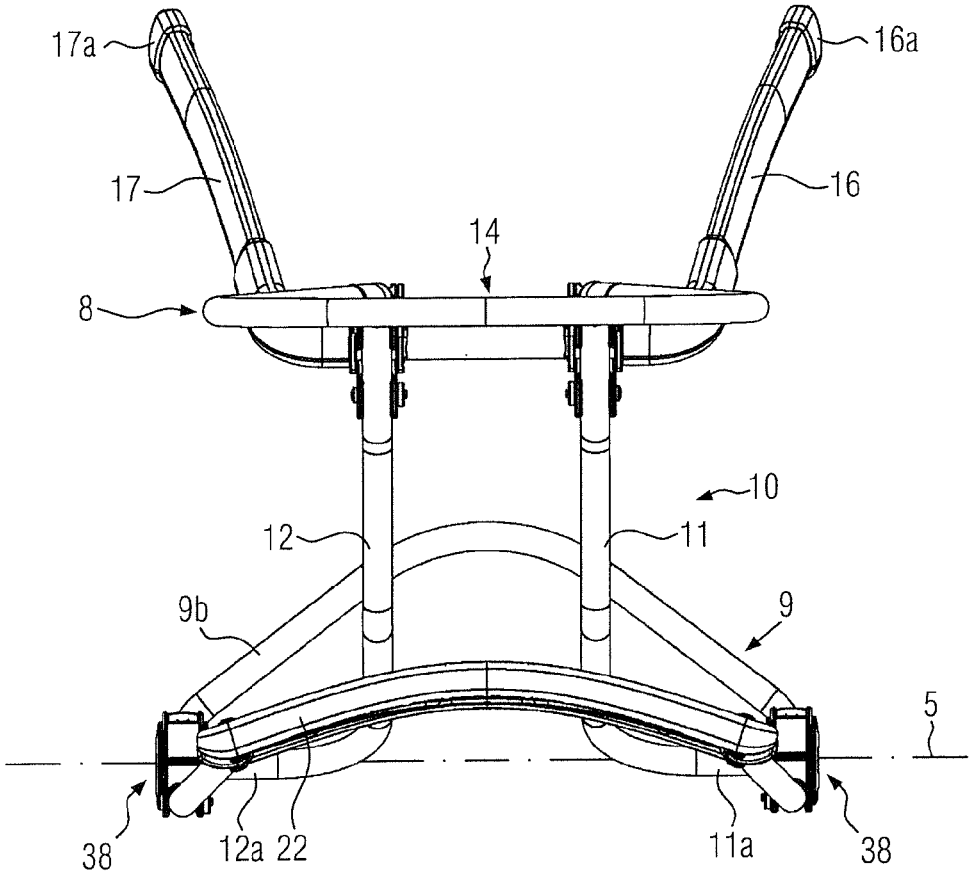
FIG. 2 shows a top view of the carrier frame of FIG. 1.

In the following, embodiments of the present subject matter are described on the basis of the drawings. It is to be mentioned that the drawings show a specific embodiment as explained below. Alternative modifications as specified in the description are at least in part not illustrated in the drawings. Furthermore, same reference signs used in the drawings denote same components.

In FIG. 1 a perspective view of an embodiment of a carrier frame 2 for a child carrier of the present subject matter is shown. The carrier frame 2 comprises a first frame element 3, a second frame element 4 coupled to the first frame element and a stand 15 coupled to the second frame element 4.

Figure 3:
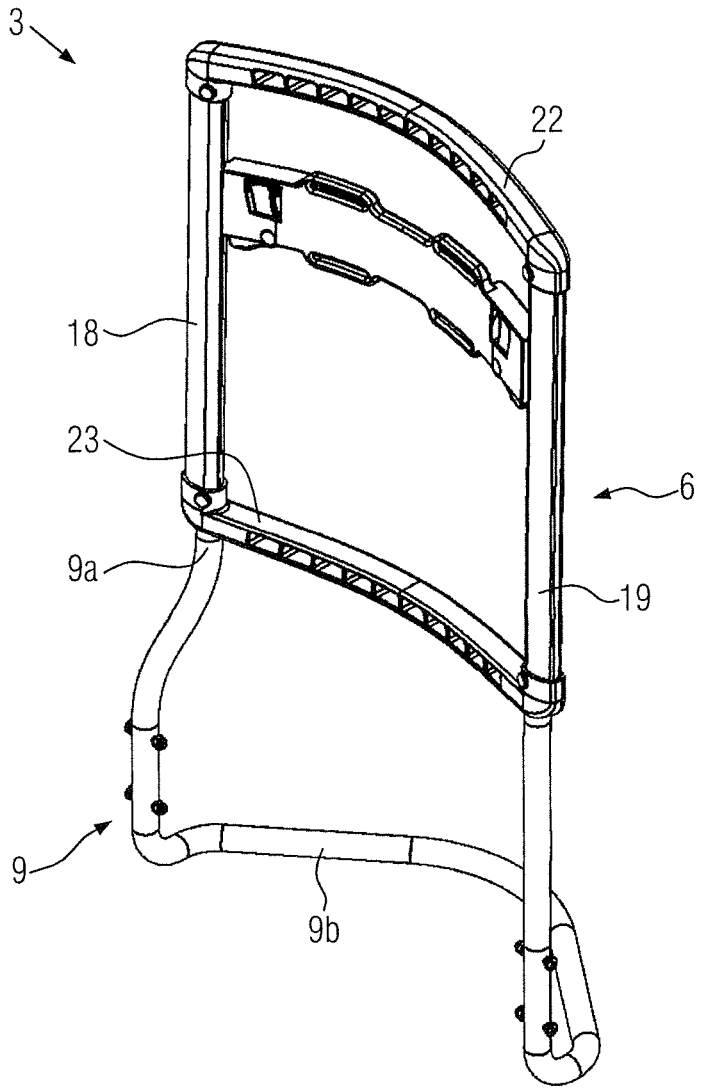
FIG. 3 shows a first frame element of the carrier frame of FIG. 1 in a perspective view.

The first frame element 3 is shown in FIG. 3 and comprises a substantially rectangular main frame 6. The main frame 6 comprises two rack portions 18, 19 and two connecting bars 22, 23. The rack portions 18, 19 are arranged in parallel to each other and the connecting portions 22, 23 connect the ends of the rack portions 18, 19 with each other. Furthermore, the connecting portions 22, 23 extend in parallel to each other and substantially perpendicular to the rack portions 18, 19. Accordingly, the rack portions 18, 19 and the connecting portions 22, 23 form the main frame 6 having a closed shape. In other words, by use of the connecting members 22, 23, the rack portions 18, 19 are held spaced to each other such that the distance between the same is maintained constant over the entire length of the rack portions 18, 19.

According to the embodiment, the rack portions 18, 19 are aluminum extruded parts. Thus, each of the rack portions 18, 19 is integrally formed. The connecting bars are plastic cast parts and are constructed in a lightweight but rigid manner.

As is shown in FIG. 3, the first frame element 3 further comprises a sub-frame 9 connected to the main frame at two positions. In other words, the sub-frame 9 forms an extension of the main frame 6. The sub-frame 9 comprises a connecting portion 9*a* and a stand portion 9*b*. The stand portion 9*b* is formed so as to provide a stable support against the ground. In order to achieve such a stable support, the stand portion 9*b* is formed substantially perpendicular to the extension direction of the rack portions 18, 19. In order to provide a smooth transition between the main frame 6 and the sub-frame 9, the connecting portions 9*a* of the sub-frame 9 are formed so as to extend in substantially the same direction as the rack portions 18, 19. As is shown in FIG. 3, the sub-frame 9 forms the lower portion of the first frame element 3. Thus, the connecting portions 9*a* of the sub-frame 9 are connected to the lower portion of the main frame 6. According to the present embodiment, the sub-frame 9 is formed as a tubular member comprising a substantially constant outer diameter over its entire length. The tubular member itself comprises multiple tube sections fixedly coupled to each other in order to form the sub-frame 9.

While the rack portions 18, 19 are formed straight and arranged so as to extend in one plane, the connecting bars 22 and 23 do not comprise a straight shape. More precisely, the connecting bars 22 and 23 each comprise a curved shape. More precisely, the connecting bars 22 and 23 are formed corresponding to the shape of the back of a user. Furthermore, the stand portion 9*b* of the sub-frame 9 at least in one section comprises a curved shape as well.

Figure 4:
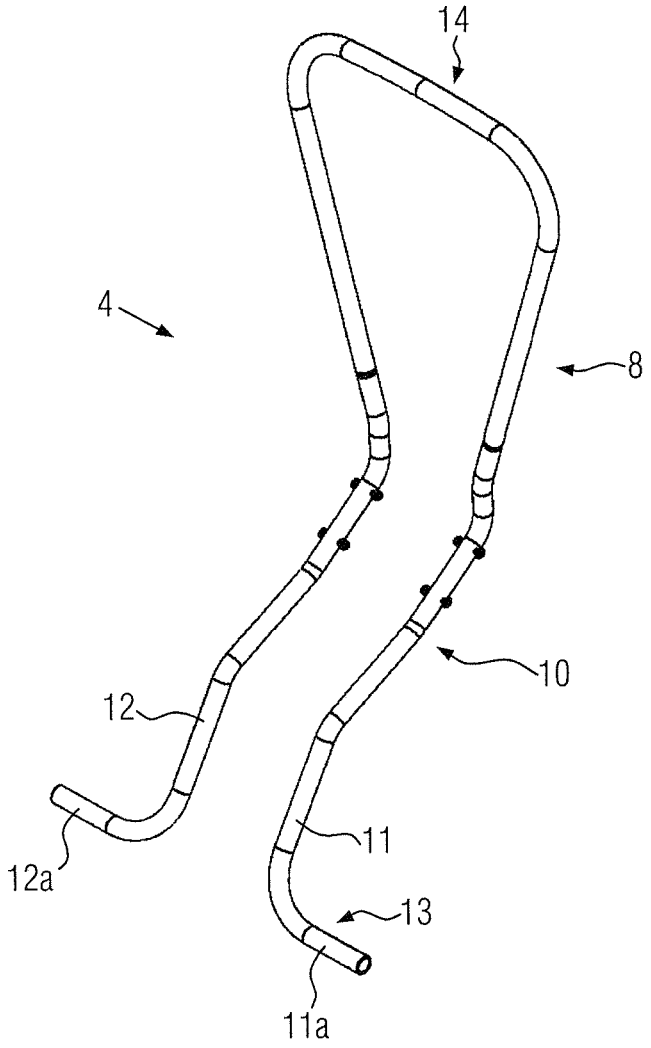
FIG. 4 shows a perspective view of a second frame element of the carrier frame of FIG. 1.

The second frame element 4 is shown in FIG. 4. The second frame element 4 comprises a backrest portion 8, a transition portion 10 and a connecting portion 13. The backrest portion 8, the transition portion 10 and the connecting portion 13 are integrated so as to form the second frame element 4. The second frame element 4 is a three-dimensionally formed part which is formed by an elongate tubular curved element. More precisely, the second frame element 4 comprises two leg portions 11 and 12 which are coupled to each other at a coupling portion 14. Consequently, the second frame element 4 is formed in an open loop in which the free ends 11*a*, 12*a* of the leg portions 11, 12 that are not coupled to each other at the coupling portion 14 form a hinge portion which can be coupled to the first frame element 3.

As is further shown in FIG. 4, the coupling portion 14 is provided at an upper end of the backrest portion 8 and the backrest portion 8 is coupled to the transition portion 10 at a lower portion thereof. The width of the backrest portion 8 is reduced from the upper portion towards the lower portion. Consequently, the width of the backrest portion 8 in the lower portion is smaller than the width of the backrest at the other portion. The transition portion 10 is connected to the lower portion of the backrest portion 8 such that there is a smooth transition regarding the width of the second frame element. In other words, the width of the lower portion of the backrest portion 8 substantially corresponds to a width of the transition portion 10. More precisely, the leg portions 11, 12 are formed parallel to each other wherein the distance between the same is maintained constant in the transition portion 10.

The free ends 11*a*, 12*a* of the leg portions 11, 12 are formed so as to be aligned with a hinge axis 5. In other words, the free ends 11*a*, 12*a* of the leg portions 11, 12 are curved so as to extend substantially perpendicular to the extensions direction of the sections of the leg portions 11, 12 forming the transition portion 10. Furthermore, the free ends 11*a*, 12*a* of the leg portions 11, 12 are bent such that they extend in opposite directions. Consequently, as regards the shape of the second frame element 4, the transition portion 10 is the section of the second frame element 4 comprising the smallest width in the second frame element 4.

Figure 5:
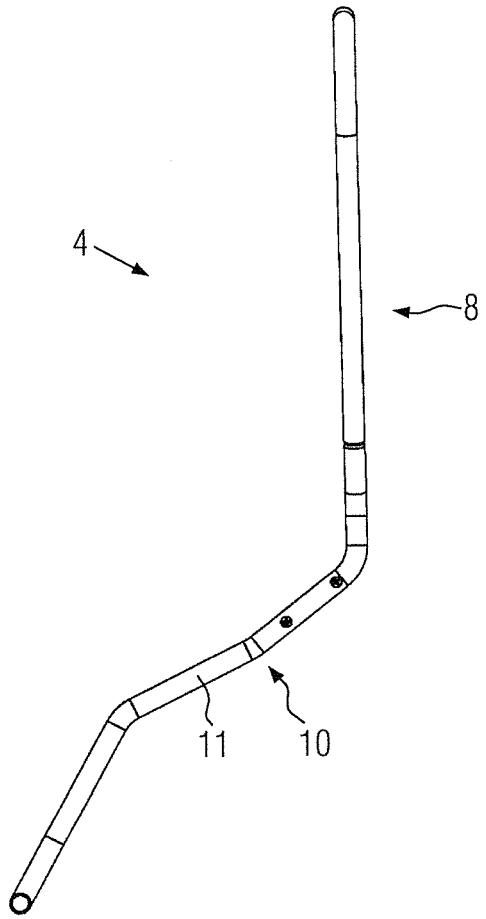
FIG. 5 shows a side view of the second frame element of FIG. 4.

As is also shown in FIG. 4, the backrest portion 8 is coupled to the transition portion 10 at a specific angle. In order to provide such an angled connection, the second frame element 4 comprises a bent-shape in which the backrest portion 8 is bent about a bending axis extending parallel to the hinge axis 5. As is also derivable from the above description, the second frame element 4 is formed symmetric with respect to a symmetry plane in which a coupling point of the coupling portion 14 is located. The angled connection between the backrest portion 8 and the transition portion 10 is also shown in FIG. 5 which is a side view of the second frame element 4.

Figure 6:
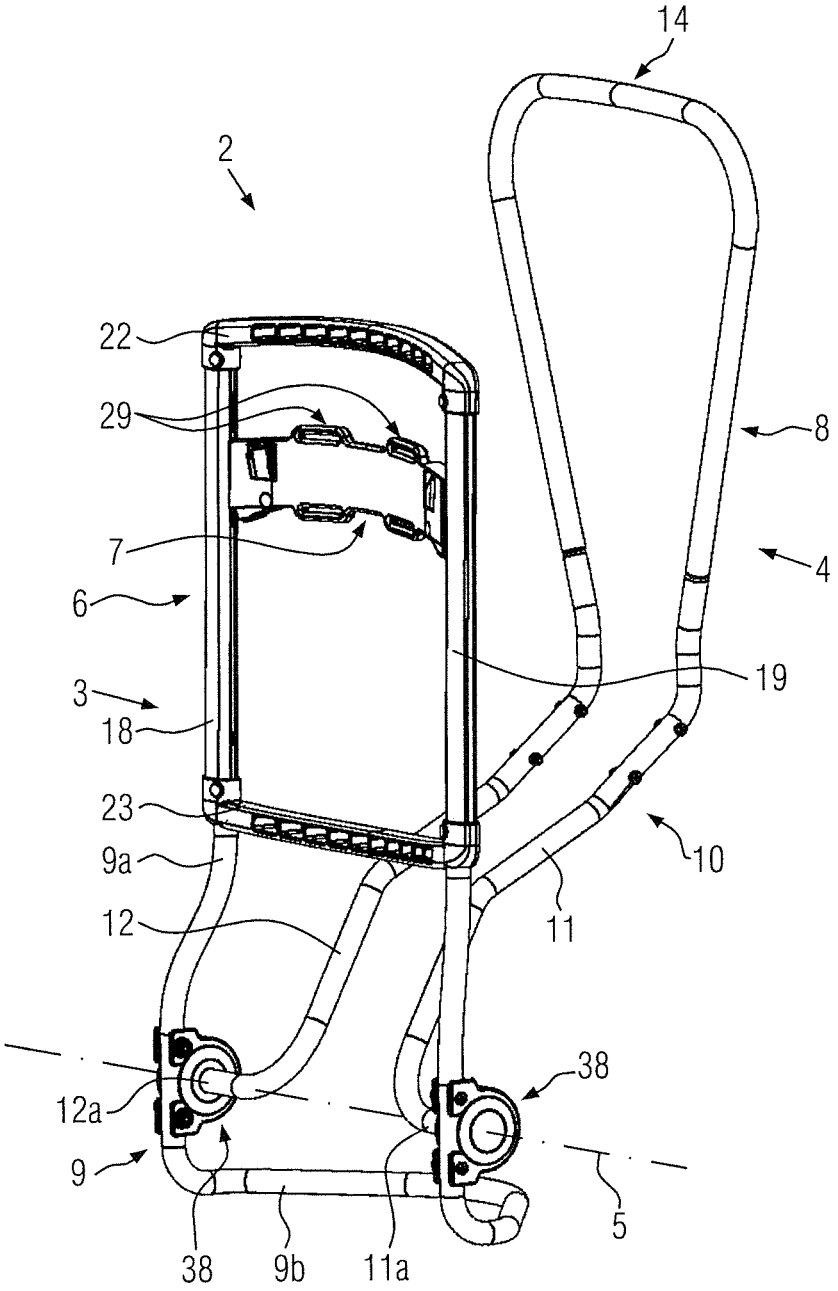
FIG. 6 shows a perspective view of a carrier frame comprising the first frame element of FIG. 3 and the second frame element of FIG. 4.
Figure 7:
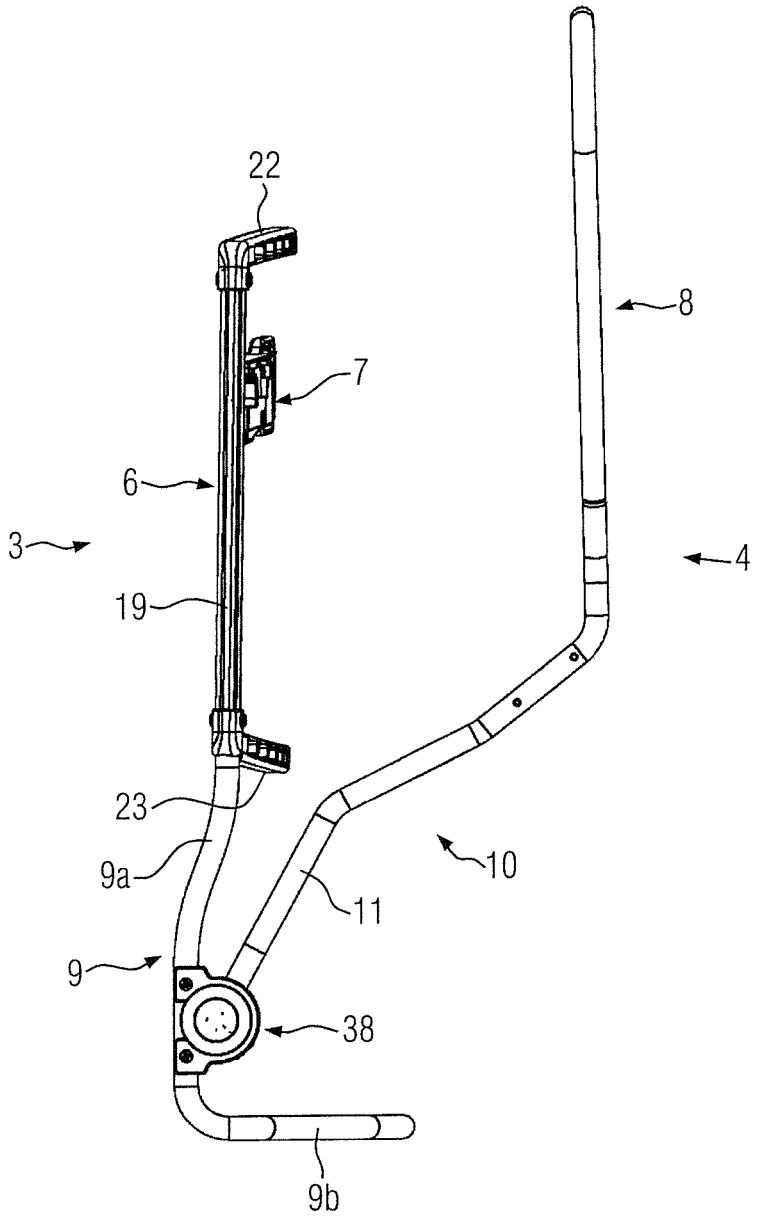
FIG. 7 shows a side view of the carrier frame of FIG. 6.

FIG. 6 shows a perspective view of a carrier frame 2 in which the second frame element 4 is hingedly coupled to the first frame element 3. The connection between the second frame element 4 and the first frame element 3 is realized by means of a hinge bearing 38. The hinge bearing 38 is provided at a lower portion of the sub-frame 9 of the first frame element 3. Consequently, a force transferred from the second frame element 4 to the first frame element 3 is induced at a lower portion of the first frame element 3. The connection of the second frame element 4 with the first frame element 3 is also shown in FIG. 7.

Figure 8:
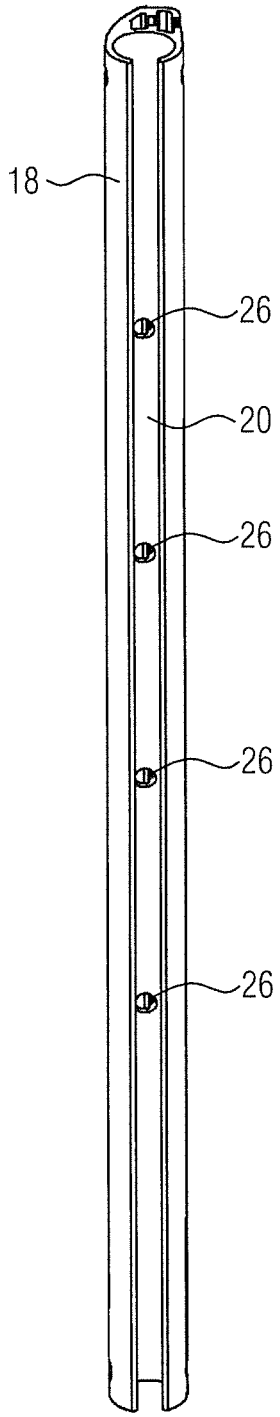
FIG. 8 shows a perspective view of a rack portion of the first frame element of FIG. 3.

FIG. 8 shows a perspective view of a rack portion 18 provided in the main frame 6 of the first frame element 3. The rack portion 18 is an extruded profile made of aluminum. Furthermore, the rack portion 18 comprises a groove 20 over its entire length. As is also shown in FIG. 8, four locking holes 26 are provided on the bottom of the groove 20. As will be described later, the locking holes 26 are cavities for receiving a locking member 25 of a locking mechanism 24. As is shown at the upper end of the rack portion 18 in FIG. 8, the interior of the groove 20 has a substantially round cross section which is open on the side opposite to the bottom of the groove 20. In other words, an elongate slit is formed in the longitudinal direction of the rack portion 18 connecting the interior space of the groove 20 with the outside of the rack portion 18. The width of the slit is smaller than the width of the interior space of the groove 20. Consequently, the groove 20 can accommodate a counter member insertable in the longitudinal direction thereof and guide the same in the longitudinal direction, i.e. in the second direction. However, since the width of the slit is smaller than the width of the interior of the groove 20, the counter member cannot be disengaged from the groove 20 through the slit. Accordingly, the rack portion 18 forms a suitable guiding means.

As is shown in FIG. 1 and FIG. 6, an adjustable support 7 comprising a shoulder strap adjustment bar 28 is slidably moveable engaged with the grooves 20 of the rack portions 18, 19. Consequently, the adjustable support 7 is moveable in the longitudinal direction of the rack portions 18, 19, i.e. in the second direction.

Figure 9:
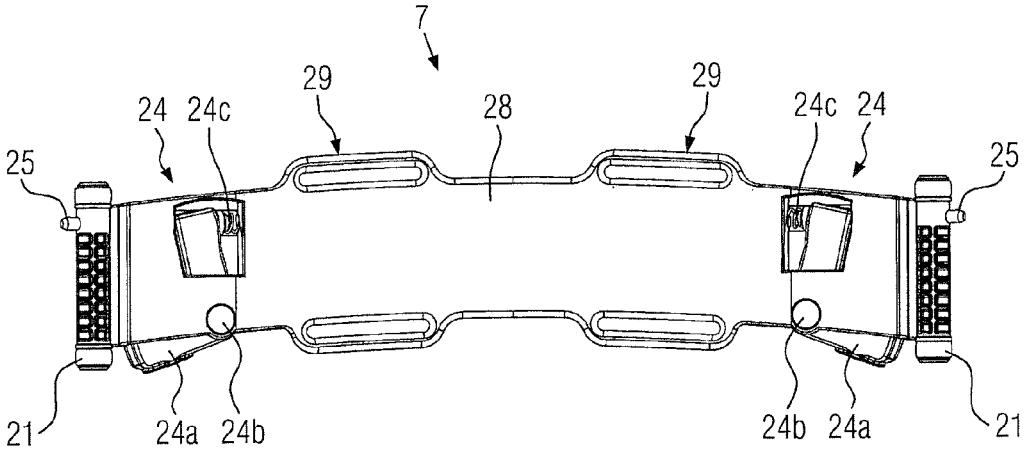
FIG. 9 shows a plan view of an adjustable support as provided in the carrier frame of FIG. 1 and the carrier frame of FIG. 6.

FIG. 9 shows a plan view of the adjustable support 7. As already mentioned above, the adjustable support 7 comprises a shoulder strap adjustment bar 28 which extends parallel to the hinge axis 5 as shown in FIG. 1 and FIG. 6. The shoulder strap adjustment bar 28 comprises shoulder strap attachment openings 29 formed therein. The shoulder strap attachment openings 29 comprise a slit-like shape and are suitable for receiving the end of a shoulder strap. Accordingly, the shoulder strap can be directly fixed to the shoulder strap adjustment bar 28 which eliminates the need for additional elements. By this, a good force distribution on the adjustable support 7 is achieved leading to an enhanced carry comfort.

As is further shown in FIG. 9, the shoulder strap adjustment bar 28 further comprises a guided portion 21 on each side thereof. According to the embodiment, the guided portions 21 of the shoulder strap adjustment bar 28 comprise an elongate substantially cylindrical shape and are formed corresponding to the grooves 20 formed in the rack portions 18, 19. In other words, the guided portions 21 of the shoulder strap adjustment bar 28 are formed corresponding to the shape of the groove 20 so as to be slidably engaged therewith.

The shoulder strap adjustment bar 28 further comprises a locking mechanism 24 on each side. The locking mechanism mainly comprises a locking element 25 which is a locking pin according to the present embodiment. Furthermore, the locking mechanism 24 comprises a lever 24*a* which is operatively connected to the locking pin 25 at one end, pivotably coupled about a pivot pin 24*b* on the shoulder strap adjustment bar 28 and comprises an actuating portion which—upon actuation—effects a pivoting movement of the lever 24*a* about the pivot pin 24*b*. The lever 24*a* and the locking pin 25 are arranged such that the rotational movement of the lever leads to a translational movement of the locking pin. Furthermore, the locking mechanism 24 comprises a spring 24*c* which pre-tensions the locking pin 25 in a direction so as to protrude from the guided portion 21 and to engage with a locking hole 26. Accordingly, when the shoulder strap adjustment bar 28 is mounted in the grooves 20 of the rack portions 18, 19, the locking pin 25 is urged against the bottom portion of the groove 20 and is pushed into a locking hole 26 in case the locking hole is aligned with the locking pin 25 due to the force applied by the spring 24*c*. On the other hand, in case the actuating portion of the lever 24*a* is actuated a movement of the locking pin 25 is effected in a direction in which the locking pin 25 is disengaged from the locking hole 26. Therefore, in case the locking mechanism 24 is actuated on both sides, the shoulder strap adjustment bar 28 is in a disengaged state and is slidable in the groove 20 of the rack portions 18, 19.

Referring now to FIGS. 10 to 14, the child carrier 1 comprises the carrier frame 2 as described before as well as harness arrangement 32 mounted on the first frame element 3 and the second frame element 4. The harness arrangement comprises two shoulder straps 30 fixedly coupled to the shoulder strap adjustment bar. Furthermore, the harness arrangement comprises a hip belt provided at a lower end of the sub-frame 9 substantially at a position where the hinge bearing 38 is provided.

The child seat arrangement 32 comprises a front portion 39, side portions 40, 41, a back portion 42 as well as a saddle like seating 34. The child seat arrangement 34 is made of a soft material provided around the carrier frame 2.

Figure 10:
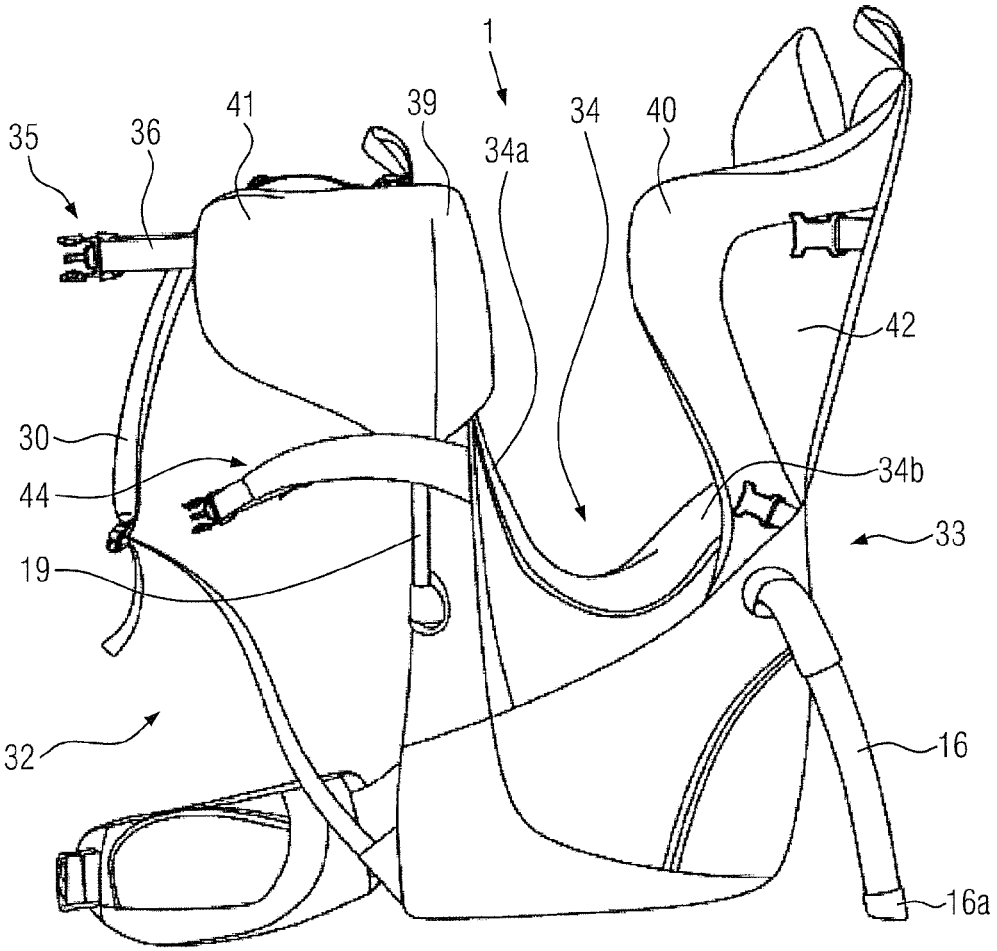
FIG. 10 shows a side view of a child carrier comprising the carrier frame of FIG. 1.
Figure 11:
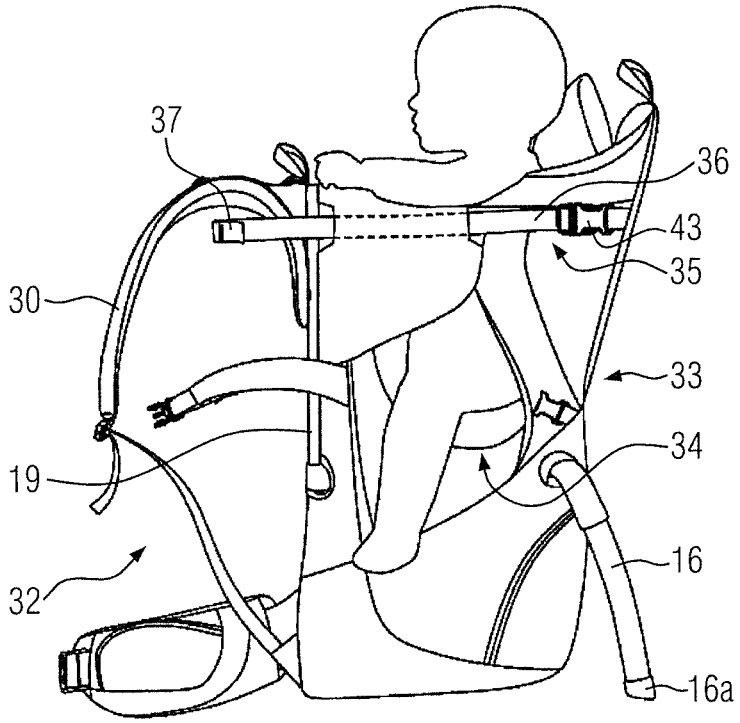
FIG. 11 shows a side view of the child carrier of FIG. 10 with an adjustment strap arrangement for adjusting an angle between the first frame element and the second frame element.
Figure 12:
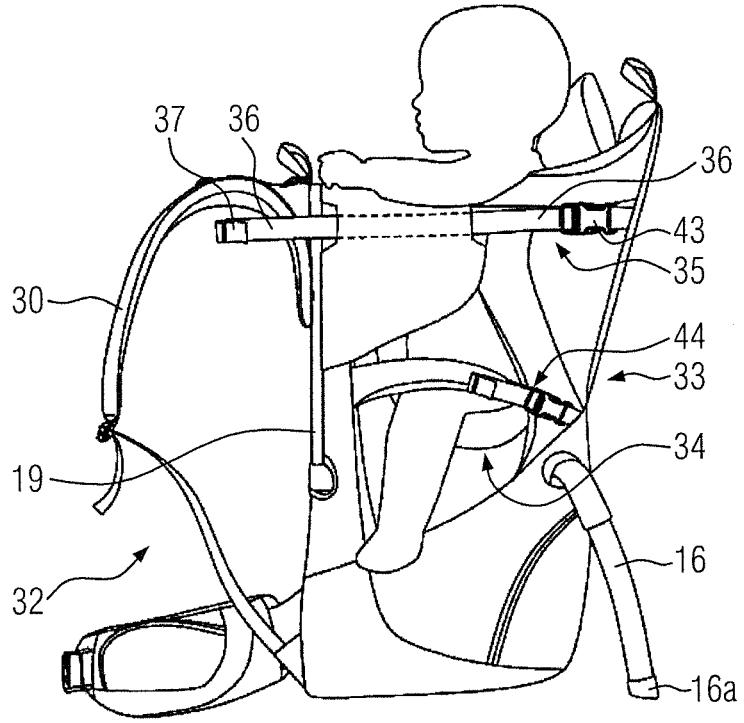
FIG. 12 shows the child carrier of FIG. 11 with a closed leg loop strap arrangement.

As is shown in FIG. 10, the front portion 39 and one side portion 41 are mounted on the first frame element 3 on the opposite side to where the harness arrangement 32 is arranged. The back portion 42 and the side portion 40 of the child seat arrangement 32 are provided on the second frame element 4. A first end 34*a* of the saddle like seating 34 is connected to the front portion 39 and a second end 34*b* of the saddle like seating 34 is connected to the back portion 42. Accordingly, the saddle like seating 34 is arranged between the first frame element 3 and the second frame element 4.

The side portion 41 is mounted on the first frame element 3 so as to be foldable about the rack portion 19. Although not shown in the figures, two front side portions are provided on the first frame element 3 on both sides of the same. The first side portions 41 are foldable in a backward direction so as to get in contact with the back side portions 40 in order to close the child seat area on the sides of the child carrier.

An adjustment strap arrangement 35 is provided for connecting the first frame element 3 with the second frame element 4 thereby connecting the front portion 39 with the back portion 42 of the child seat arrangement 33. By this, the adjustment strap arrangement 35 is suitable for adjusting the distance between the back portion 42 and the front portion 39 of the child seat arrangement 34. Consequently, the space can be adjusted as necessary. For example, in case the child carrier is used when hiking in the mountains, it is desirable to securely accommodate the child in the carrier. This can be achieved by tightening the child against the front portion 39 which can be effected by adjusting the length of the adjustment strap arrangement 35 correspondingly.

Figure 13:
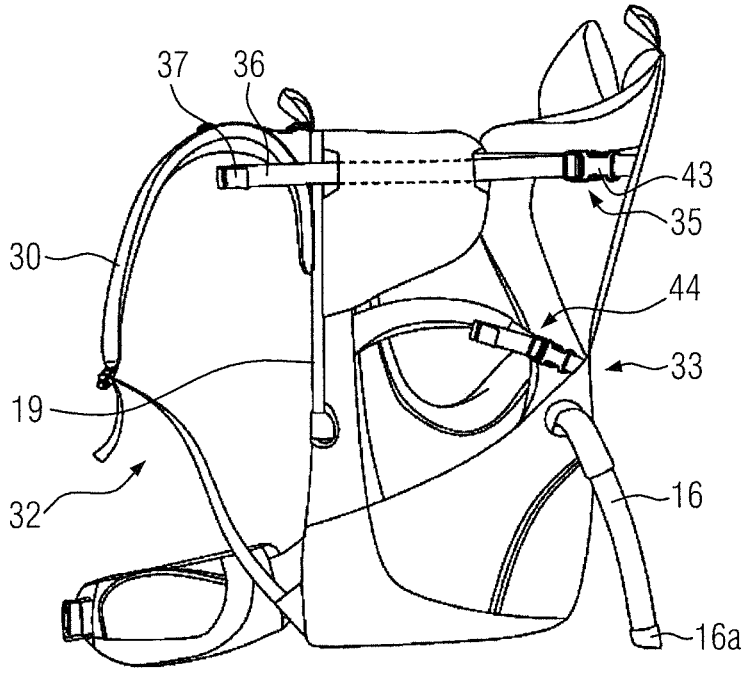
FIG. 13 shows the child carrier of FIG. 12 in a wide configuration.
Figure 14:
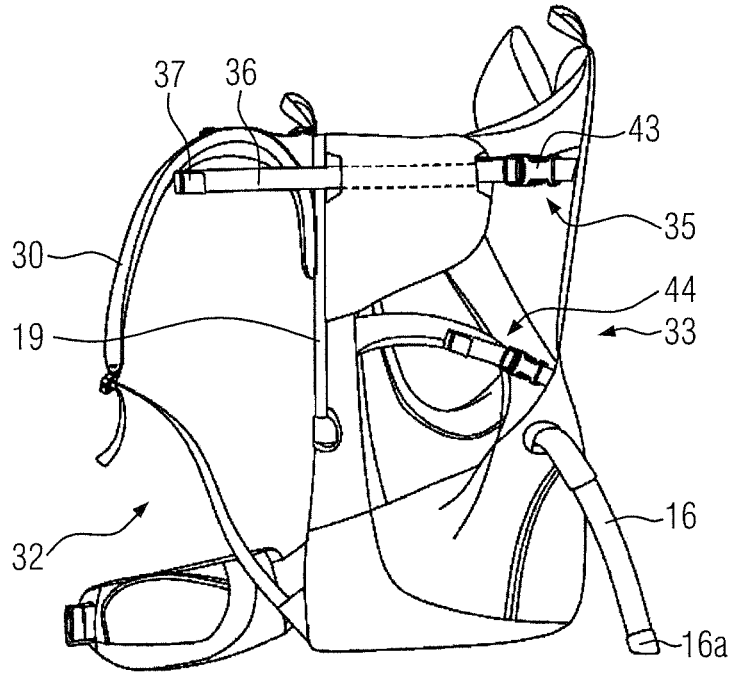
FIG. 14 shows the child carrier of FIG. 10 with a narrow configuration.

The adjustment strap arrangement 35 comprises a length adjustable strap 36 which is connected to the first frame element 3. The length adjustable strap 36 is connected to a side release buckle 43 at an adjusting side thereof. Thus, the adjustable strap 36 extends from the first frame element 3 at which it is fixed, passes through the adjusting side of the side release buckle 43 in an adjustable manner and extends towards the first frame element 3 so that the free end 37 is arranged at a position at which the user can grasp the same during carrying the child carrier 1 on the back. In the embodiment, the adjustable strap 36 is passed through an interior portion of the side portion 41 which configuration serves as a suitable guiding means for providing the free end 37 at the desired position as described above. The length of the length adjustable strap 36 can be adjusted by pulling the free end 37 thereof. In this connection, FIG. 13 shows a wide configuration of the child carrier 1 in which the length adjustable strap 36. FIG. 14 shows a narrow configuration of the child carrier 1 in which the free end 37 of the adjustable strap arrangement 35 has been pulled so as to shorten the length of the adjustment strap arrangement compared to the configuration shown in FIG. 13. Accordingly, the distance between the back portion 42 and the front portion 39 of the child seat arrangement 32 is reduced in the configuration shown in FIG. 14.

A leg loop strap arrangement 44 is additionally provided as can be seen from FIGS. 10 to 14. The leg loop strap arrangement 44 is provided between the saddle like seating 34 and the adjustment strap arrangement 35. By this, the dimension of an opening through which the child's leg is passed when it is seated can be reduced so that the child cannot slip through that opening when it is seated in the child carrier 1. The leg loop strap arrangement 44 is length adjustable and can be suitably used to tighten the child's leg to the child carrier 1. Similarly to the adjustment strap arrangement 35 described above, the leg loop strap arrangement 44 can comprise a side release buckle for opening the same.

The invention claimed is:

1. A carrier frame for a child carrier, the carrier frame comprising:

a first frame element and a second frame element hingedly coupled to the first frame element about a hinge axis, the first frame element comprising a main frame and an adjustable support, the adjustable support extending in a first direction substantially parallel to the hinge axis and being movable in a second direction substantially perpendicular to the hinge axis, and the second frame element comprising a transition portion and a backrest portion, wherein an angle is formed between the backrest portion and the transition portion, wherein the transition portion has a width in the first direction smaller than a maximum width of the carrier frame.

2. The carrier frame according to claim 1, wherein the second frame element comprises two leg portions, the leg portions being formed substantially parallel and spaced to each other in the transition portion.

3. The carrier frame according to claim 2, wherein the leg portions are three-dimensionally formed and coupled to each other so as to form an open loop.

4. The carrier frame according to claim 2, wherein the leg portions have a tubular shape and comprise a substantially constant cross-sectional profile.

5. The carrier frame according to claim 1, further comprising a stand having two integrated stand leg portions, the stand leg portions being hingedly coupled to the second frame element and comprising a free end contactable to the ground.

6. The carrier frame according to claim 1, wherein the main frame comprises two rack portions extending in the second direction, wherein each of the two rack portions has a guide means and wherein the adjustable support extends between the two rack portions and is slidably engaged with the guide means of the rack portions.

7. The carrier frame according to claim 6, wherein the guide means is a groove and the adjustable support comprises a guided portion slidably accommodated in the groove.

8. The carrier frame according to claim 7, wherein the main frame further comprises at least two connecting bars extending in the first direction and being coupled to the two rack portions.

9. The carrier frame according to claim 1, further comprising a locking mechanism for releasably locking the adjustable support with respect to the main frame.

10. The carrier frame according to claim 9, wherein the locking mechanism comprises a locking element releasably engageable with a locking cavity of at least two locking cavities formed in the main frame.

11. The carrier frame according to claim 1, wherein the adjustable support comprises a shoulder strap attachment bar having at least two shoulder strap attachment means for directly attaching shoulder straps on the shoulder strap attachment bar.

12. A child carrier comprising:

a carrier frame comprising:

a first frame element and a second frame element hingedly coupled to the first frame element about a hinge axis, the first frame element comprising a main frame and an adjustable support, the adjustable support extending in a first direction substantially parallel to the hinge axis and being movable in a second direction substantially perpendicular to the hinge axis, and the second frame element comprising a transition portion and a backrest portion, wherein an angle is formed between the backrest portion and the transition portion, wherein the transition portion has a width in the first direction smaller than a maximum width of the carrier frame;

a harness arrangement comprising at least two shoulder straps, wherein the shoulder straps are coupled to the adjustable support; and a child seat arrangement comprising a saddle like seating arranged between the first frame element and the second frame element in the area of the transition portion in the first direction.

13. The child carrier according to claim 12, wherein the width of the transition portion is equal to or smaller than the width of the saddle like seating.

14. The child carrier according to claim 13, wherein the transition portion is at least partially formed following the shape of the saddle like seating.

15. The child carrier according to claim 12, further comprising an adjustment strap arrangement for adjusting an angle between the first frame element and the second frame element, the adjustment strap arrangement comprising at least one length adjustable strap operatively connected to the first frame element on one side and operatively connected to the second frame element on the other side, wherein the length of the length adjustable strap is adjusted by pulling a free end thereof and wherein the length adjustable strap is arranged with the free end positioned on a side of the first frame element.

* * * * *